US008979418B2

(12) United States Patent
Whiteley

(10) Patent No.: US 8,979,418 B2
(45) Date of Patent: Mar. 17, 2015

(54) BARRIER

(75) Inventor: Christopher James Whiteley, Enstone (GB)

(73) Assignee: Oxford Plastic Systems Limited, Oxfordshire, Enstone (GB)

( * ) Notice: Subject to any disclaimer, the term of this patent is extended or adjusted under 35 U.S.C. 154(b) by 0 days.

(21) Appl. No.: 13/417,790

(22) Filed: Mar. 12, 2012

(65) Prior Publication Data

US 2013/0236246 A1 Sep. 12, 2013

(51) Int. Cl.

| | |
|---|---|
| ***E01F 13/00*** | (2006.01) |
| ***E01C 5/16*** | (2006.01) |
| ***E01C 9/08*** | (2006.01) |
| ***E01C 15/00*** | (2006.01) |
| ***E01F 13/02*** | (2006.01) |

(52) U.S. Cl.

CPC ..... *E01C 15/00* (2013.01); *E01C 9/086* (2013.01); *E01F 13/022* (2013.01)

USPC ..... 404/6; 404/35

(58) Field of Classification Search

CPC ..... E04F 11/18; E04F 11/181; E01F 13/00; E01F 13/02; E01F 15/00; E01F 15/0423

USPC ..... 404/6, 9, 10, 12, 15, 36, 19, 35; 256/13.1; 52/174, 184, 296, 297; 14/73, 69.5

See application file for complete search history.

(56) References Cited

U.S. PATENT DOCUMENTS

| | | | | | |
|---|---|---|---|---|---|
| 1,526,359 | A | * | 2/1925 | Michie | 52/174 |
| 2,284,022 | A | * | 5/1942 | Schmeller, Sr. | 14/69.5 |
| 2,308,943 | A | * | 1/1943 | Tietig et al. | 52/781 |
| 2,706,662 | A | * | 4/1955 | Brown | 182/113 |
| 3,881,698 | A | * | 5/1975 | Marsh | 256/59 |
| 4,271,555 | A | * | 6/1981 | Mingolla et al. | 14/73 |
| 4,669,577 | A | * | 6/1987 | Werner | 182/113 |
| 4,854,767 | A | * | 8/1989 | Sasaki | 404/6 |
| 4,930,752 | A | * | 6/1990 | Wolper, Jr. | 256/13.1 |
| 5,149,061 | A | * | 9/1992 | Borgnini | 256/24 |
| 5,314,167 | A | * | 5/1994 | Holloman | 256/69 |
| 5,406,039 | A | * | 4/1995 | Rerup et al. | 181/210 |
| 5,920,936 | A | * | 7/1999 | Wiedeck et al. | 14/14 |
| 6,141,927 | A | * | 11/2000 | Usui | 52/263 |
| 6,142,701 | A | * | 11/2000 | Falcon | 404/6 |

(Continued)

FOREIGN PATENT DOCUMENTS

| | | |
|---|---|---|
| DE | 4217255 | 12/1993 |
| EP | 1566483 | 8/2005 |
| FR | 2941480 | 7/2010 |
| JP | 10148036 | 6/1998 |

OTHER PUBLICATIONS

FlexWalk Systems, Jul. 9, 2011, https://web.archive.org/web/20110709181912/http://fall-arrest.com/fall-arrest-systems/rooftop-fall-protection/rooftop-flex-walk.asp.*

(Continued)

*Primary Examiner* — Abigail A Risic

(74) *Attorney, Agent, or Firm* — Andrus Intellectual Property Law, LLP

(57) ABSTRACT

A barrier arrangement comprising a barrier panel 14, a walkway surface 10, and a bracket 20 securable to the walkway surface 10 and operable to secure the barrier panel 14 to the walkway surface 10, holding the barrier panel 14 in an upright configuration.

9 Claims, 4 Drawing Sheets

(56) References Cited

U.S. PATENT DOCUMENTS

| | | | | |
|---|---|---|---|---|
| 7,810,285 | B1 * | 10/2010 | Liptak | 52/69 |
| 2002/0144364 | A1 * | 10/2002 | Anderson et al. | 14/69.5 |
| 2006/0059636 | A1 * | 3/2006 | Suggate | 14/69.5 |
| 2007/0020044 | A1 * | 1/2007 | Stratton | 404/9 |

OTHER PUBLICATIONS

Flexible Lifeline Systems, FlexWalk, Jul. 9, 2011, pp. 14-16.*

English Abstract of JP 10148036; published Jun. 2, 1998; Fujita Corp. and Kasetsu Kogyo KK.

English Abstract of EP 1 566 483; published Aug. 24, 2005; Purus Arzberg GmbH.

English Abstract of DE 42 17 255; published Dec. 2, 1993; Gert-Peter Lehmann.

English Abstract of FR 2 941 480; published Jul. 30, 2010; Frenehard et Michaux Ets.

British Search Report dated Sep. 17, 2010.

* cited by examiner

BARRIER

This invention relates to a barrier arrangement intended for use in enhancing the safety of the public where works are being carried out on road or footpath surfaces, or where it is desirable to provide a barrier between, for example, pedestrians and other objects such as vehicles, aircraft or the like, or to restrict access to certain areas or situations.

Where holes, trenches or other cavities are dug into road or footpath surfaces to allow work to be undertaken on, for example, cables, pipes or the like located beneath the ground surface, it is known to erect a barrier around the cavity to reduce the risk of passers by accidentally falling into the cavity. Similarly, if a manhole cover or the like is raised to permit access to underground cables, pipes or the like, a barrier may be erected around the manhole. It will be appreciated that similar barriers can be used to separate pedestrians from, for example, road vehicles, aircraft or the like, or to restrict access to selected areas or situations.

The barriers often used in such situations comprise a series of barrier units, connected to one another in an end to end fashion, and each barrier unit comprises a panel supported upon a pair of feet, the feet protruding to both sides of the panel. In use, the protruding feet may constitute a trip hazard. Where the presence of the works significantly reduces the width of the footpath or the like, the trip hazard so formed may be unacceptably large as the feet may protrude by a significant distance across the remaining width of the footpath. One way of reducing or avoiding the formation of such a trip hazard is to provide barriers which fix to the ground surface, for example using spikes or the like. However, such an arrangement may result in damage to the ground surface which is unsightly, costly to repair and undesirable. Furthermore, installation or erection of such a barrier is time consuming.

It is an object of the invention to provide a barrier arrangement in which at least some of the disadvantages with known arrangements are overcome or are of reduced impact.

According to the present invention there is provided a barrier arrangement comprising a barrier panel, a walkway surface, and a bracket securable to the walkway surface and operable to secure the barrier panel to the walkway surface, holding the barrier panel in an upright configuration.

Such an arrangement avoids the use of feet protruding into or across the remaining part of a footpath, instead using a temporary walkway surface to provide support for the barrier panel. As a result, the formation of a significant trip hazard is avoided. Furthermore, as the barrier panel and/or temporary walkway surface can be manufactured so as to be of brightly coloured, high visibility form, the risk of passers-by tripping is further reduced, and to provide an indication of the presence of the barrier arrangement to the visually impaired. Where of high visibility, an indication may thus be provided, for example to the visually impaired, that they are close to such works, and hence that extra care may be required. Furthermore, the walkway surface may be provided with a texture which can be felt by pedestrians as they walk over the walkway surface, providing additional information to the visually impaired that they are passing over the temporary walkway surface. Conveniently, where several barrier panels are provided in an end-to-end configuration, the assembly of barrier panels defines a substantially continuous top hand rail, and conveniently also provides a substantially continuous lower rail to serve as a continuous tapping rail. Gaps in the barrier assembly, through individual barrier panels, between barrier panels, and between the barrier panels and the walkway surface are conveniently small, sufficiently small that, for example, a guide dog would be unable to pass through the gaps.

On the pedestrian side of the barrier panel, the panel conveniently extends vertically with no protrusions which would form trip hazards.

The barrier arrangement can be totally freestanding, not requiring fixing to the ground surface, Despite being free standing, the barrier is of very good stability, being capable of withstanding significant loadings or relatively high winds. It also has the benefit of being relatively tamper proof and so the risk of vandalism related damage is reduced.

Should additional ballast be required or thought desirable, then weights may be placed upon part of the walkway.

If desired, barrier panels may be positioned adjacent two or more sides of the walkway.

The invention will surface be described. by way of example, with reference to the accompanying drawings, in which.

Figure 1:
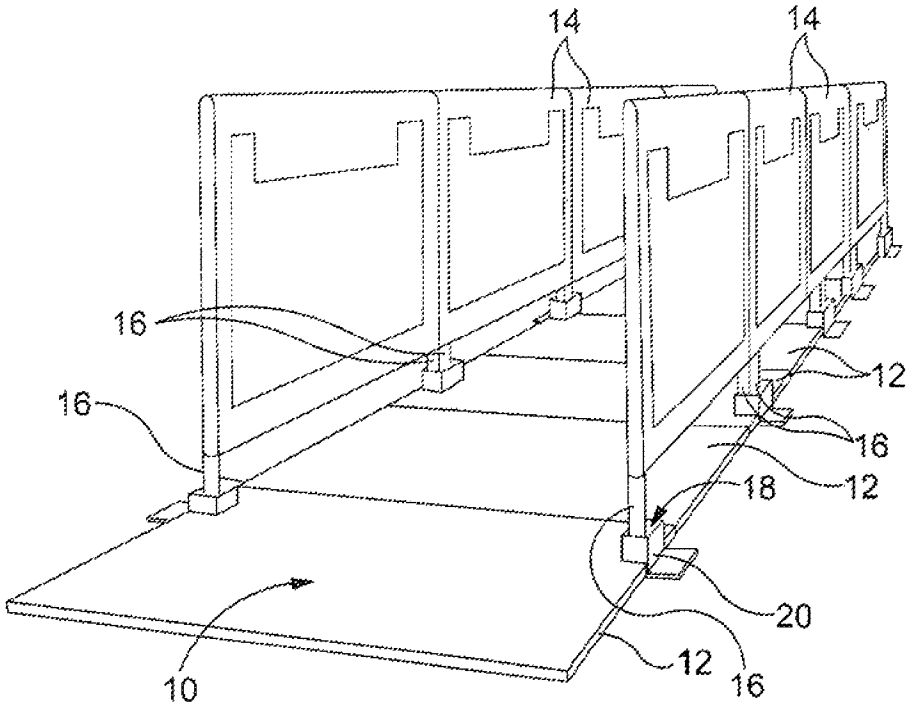
FIG. 1 is a view illustrating a barrier arrangement in accordance with one embodiment of the invention.
Figure 2:
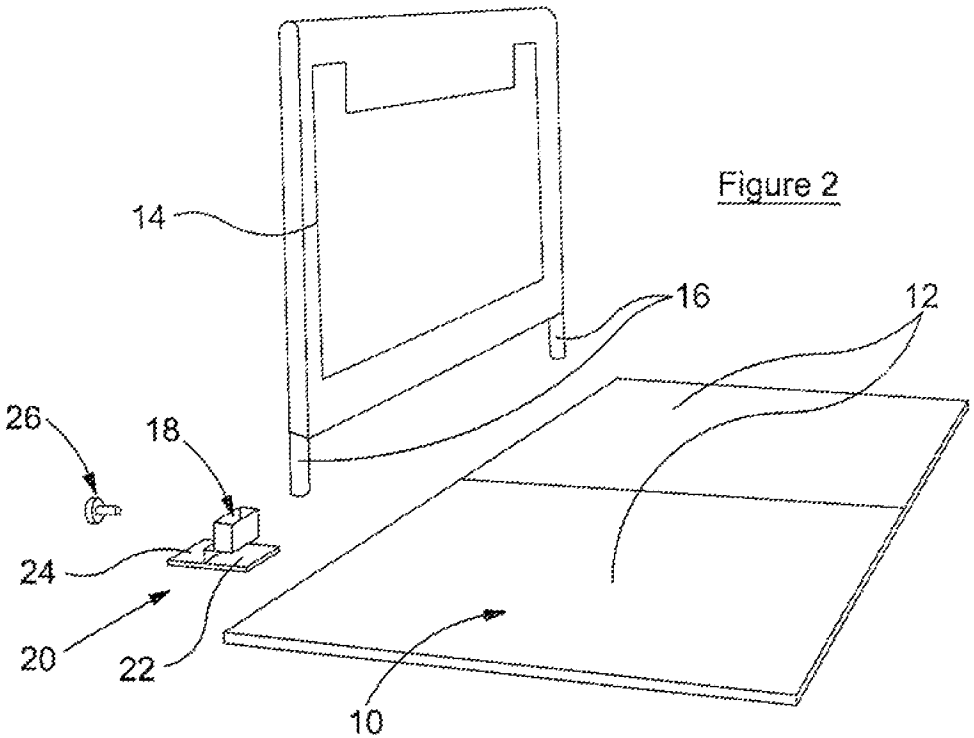
FIG. 2 is an exploded view illustrating part of the barrier arrangement of FIG. 1.

The barrier arrangement illustrated in FIGS. 1 and 2 of the accompanying drawings is intended for use in providing a safe walkway for pedestrians past a work site, for example where a cavity has been formed in a footpath or the like. However, it will be appreciated that the barrier arrangement may be suitable for use in a wide range of applications, and so the invention is not restricted in this regard. For example, it may be used to separate pedestrians for road vehicles or aircraft, or to prevent or restrict access to certain areas or sites, and so protect the public from dangerous or hazardous situations.

The barrier arrangement comprises a walkway surface 10 made up of a series of walkway panels 12. In the illustrated arrangement, the walkway panels 12 are each of generally square or rectangular moulded plastics form. Although not shown, they may be designed in such a manner as to incorporate interlocking features whereby the individual walkway panels may be secured to one another. Furthermore, they may include suitable reinforcing means to allow them to be positioned over, for example, relatively small cavities, bearing the weight of pedestrians passing over such cavities, the cavities being bridged by a single one of the walkway panels 12. However, it will be appreciated that depending upon the application in which the barrier arrangement is used, this may not always be necessary, and arrangements may be desired in which the walkway panels 12 are of flexible form so as to permit them to deform to match substantially the shape of the underlying ground surface, whilst presenting a smooth walkway surface to users.

Conveniently, each walkway panel 12 is of brightly coloured, high visibility form. The upper surface of each walkway panel may be provided with a suitable non-slip texture. If desired, logos or messages may be moulded into the surface. The underside of the walkway panels 12 may be textured so as to minimise the risk of the walkway panels 12 slipping on the underlying ground surface, if desired.

The illustrated barrier arrangement further comprises a plurality of barrier panels 14, each of which is of moulded plastics form. Adjacent its ends, each barrier panel 14 is provided with a pair of legs 16. The legs 16 may take a wide range of forms. In the arrangement illustrated they are of tubular steel form, and extend over substantially the full height of the associated barrier panel 14, but this need not always be the case. The barrier panels 14 may themselves take a wide range of forms. Although as illustrated they are of moulded plastics form, conveniently of brightly coloured form, they could be of other materials, and the design may be changed, for example to include vents or slots whereby wind resistance is reduced, or to include spaces in which messages or warnings may be displayed. Conveniently, the upper edge of each barrier panel 14 is of smoothly curved or roll-edged form so as to provide a hand rail-like formation.

The lower end of each leg 16 is fitted into an opening 18 formed in a bracket 20, the bracket 20 being adapted to be fitted onto an edge part of an associated walkway panel 12. Conveniently, a clamp mechanism (not shown) is provided whereby each bracket 20 can be firmly secured to the associated walkway panel 12. As shown, each bracket 20 includes a short limb 22 that extends beneath the walkway panel 12 and another short limb 24 that protrudes in the opposite direction, the limbs bearing against the underlying ground surface, It will be appreciated that the limb 22 that is located beneath the walkway panel 12 does not present a trip hazard as the walkway panel 12 covers this limb. The other limb 24 is located to the opposite side of the barrier panel 14 from the side facing pedestrians and so also does not present a trip hazard.

The limb 22 and socket defining the opening 18 together form or define a pocket into which an edge part of the walkway panel 12 can be fitted or clipped to secure the bracket 20 to the walkway panel 12, and thereby secure the associated barrier panel 14, firmly, in an upright configuration.

A screw 26 extends through a threaded opening provided in the bracket 20 and bears against the associated leg 16 to secure the barrier panel 14 to the bracket 20.

It will be appreciated that, in use, a series of walkway panels 12 are located adjacent one another so as to define a walkway surface over which pedestrians can pass. Brackets 20 are secured to the legs 16 of a series of barrier panels 14, and the brackets 20 then secured or clipped to the edges of the assembled walkway panels 12. The brackets 20, and the connection of the brackets 20 to the walkway panels 12, results in the barrier panels 14 being held firmly and securely in an upright configuration. If desired, connection means may be provided to allow several barrier panels 14 to be connected to one another in an end to end configuration.

As shown in FIG. 1, barrier panels 14 may be located adjacent two or more, in this case opposing, edges of the walkway panels 12, but this need not always be the case. The walkway panels 12 are conveniently of width approximately 1.2 m to ensure that a sufficiently wide walkway is provided to allow pedestrians to pass along the walkway.

Where the walkway panels 12 and/or the barrier panels 14 are brightly coloured and/or provided with a surface texture, a clear indication can be given to the partially sighted or blind that they are passing a work site. By providing a non-slip or anti-slip texture to the walkway panels 12, it will be appreciated that the risk of slipping can be reduced. The walkway panels 12 provide a good, flat, low trip hazard surface, thereby reducing the risk of accidents.

If desired, further walkway panels 12 may be provided on the 'work site' side of the barrier, enhancing stability and providing workers with a good working surface. If further stability is required, then weights may be provided upon the walkway panels 12 and/or upon the projecting limbs 24 of the brackets 20.

Figure 3:
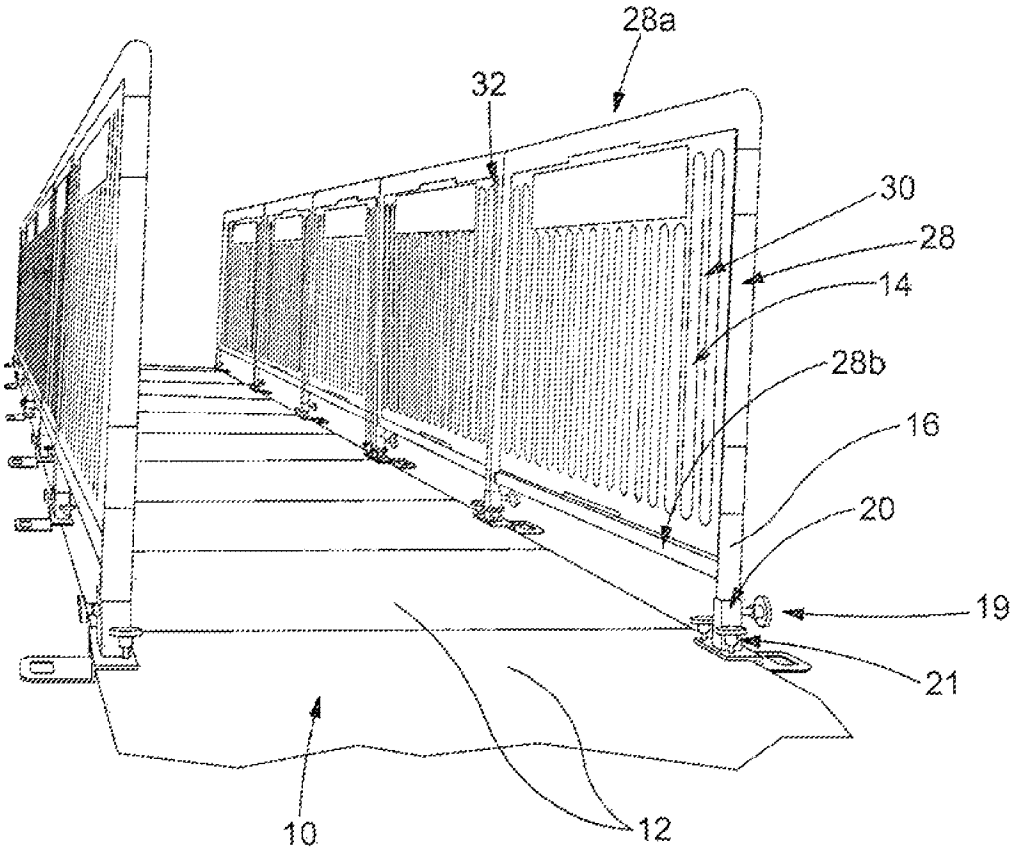
FIG. 3 is a perspective view illustrating a variant of the arrangement shown in FIGS. 1 and 2.

FIG. 3 illustrates a variant to the arrangement described hereinbefore with reference to FIGS. 1 and 2. Like reference numerals are used to denote like parts.

In the arrangement of FIG. 3, each bracket 20 includes screw threaded fixing means 21 by which the bracket 20 can be clamped or otherwise secured to the adjacent walkway panel 12. Conveniently, the screw threaded fixing means 21 comprises a threaded bolt in threaded engagement with an extending through a threaded opening formed in the bracket 20 such that an end of the bolt engages the walkway panel 12. Rotation of the bolt thus tightens the end of the bolt against the walkway panel, clamping the bracket 20 to the walkway panel 12.

A further, similar threaded fixing means 19 is provided to clamp the leg 16 of the barrier panel 14 to the bracket 20.

Each barrier panel 14 includes a frame 28 of tubular metallic construction, the frame 28 supporting an infill panel 30 of moulded plastics form. The infill panel 30 conveniently defines a series of gaps, reducing loads on the barrier 14 resulting from, for example, wind. The frame 28 includes a substantially continuous upper hand rail **28*a* and a substantially continuous lower, tap rail 28*b*. When a plurality of barrier panels 14 are arranged in an end-to-end configuration, the upper and lower rails formed from the rails 28*a*, 28*b* are substantially continuous. Each barrier panel 14** extends substantially vertically, in use, having no protrusions on the side thereof facing the pedestrians. The visually impaired should thus be able to use the barrier arrangement without difficulty.

As shown, clamps 32 may be used to secure adjacent barrier panels 14 to one another.

The walkway panels 12 are brightly and/or of contrasting colours and so are of good visibility, and are provided with a raised tactile, textured pattern which can be felt underfoot by pedestrians walking over the walkway panels 12. The barrier arrangement is thus convenient for use by the visually impaired as the tactile surface provides an indication of where it is safe to walk. Furthermore, any gaps in the barrier arrangement are sufficiently small that guide dogs or the like are unable to pass through the gaps.

Figure 4:
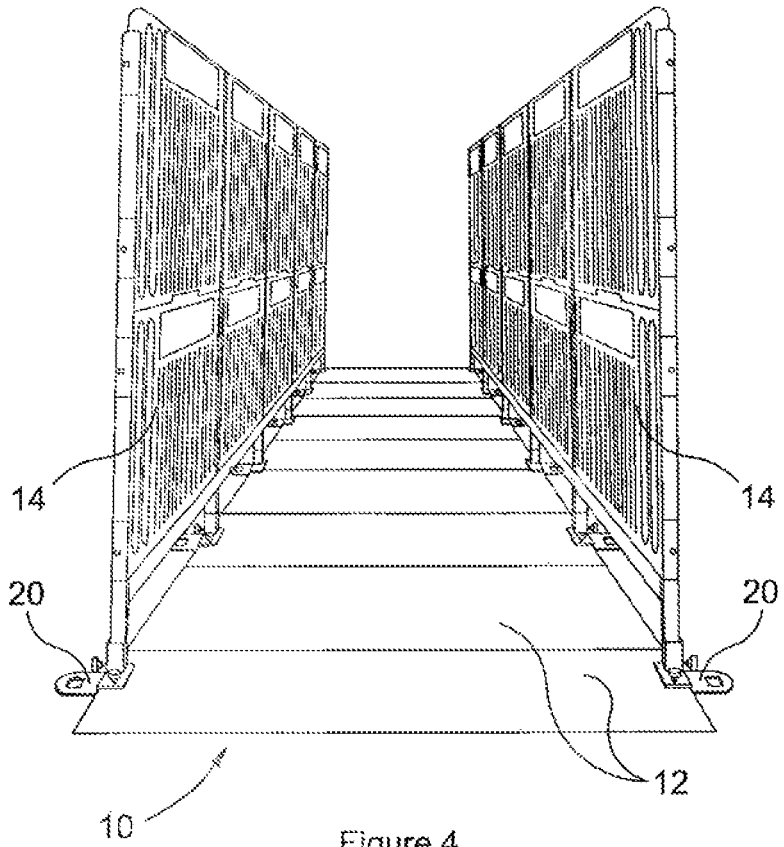
FIG. 4 illustrates a further embodiment.

Although as illustrated the barrier panels 14 are of relatively low height in the arrangements described hereinbefore, the invention may be applicable to barrier arrangements with an increased height of, say, 2 m or more, for example as shown in FIG. 4.

It will be appreciated that a wide range of modifications and alterations may be made to the arrangement described hereinbefore without departing from the scope of the invention.

The invention claimed is:

1. A freestanding barrier arrangement comprising a barrier panel, a walkway surface comprising a series of ground engaging walkway panels arranged adjacent one another and positioned, in use, upon a ground surface, the walkway panels being of molded plastic material form and being flexible so as to permit deformation thereof to match substantially the shape of the ground surface, and a bracket securable to the walkway surface and operable to secure the barrier panel to the walkway surface, holding the barrier panel in an upright configuration relative to the walkway surface, wherein the bracket includes oppositely directed ground engaging limbs engaging, in use, the ground surface, one of the ground engaging limbs extending beneath the walkway surface and engaging the underside of an adjacent one of the walkway panels so as to be directly engaged between the walkway panel and the ground surface.

2. An arrangement, according to claim 1, wherein the barrier panel and/or walkway surface are manufactured so as to be of brightly coloured, high visibility form.

3. An arrangement according to claim 1, wherein the walkway surface is provided with an anti-slip texture.

4. An arrangement according to claim 1, wherein the walkway surface is provided with a tactile textured pattern.

5. An arrangement according to claim 1, further comprising threaded fixing means whereby the bracket can be damped to the walkway surface.

6. An arrangement according to claim 1, further comprising ballast located to enhance stability.

7. An arrangement according to claim 1. wherein barrier panels are positioned adjacent two or more sides of the walkway.

8. An arrangement according to claim 1, wherein a plurality of barrier panels is arranged in an end-to-end configuration and define a substantially continuous upper hand rail.

9. An arrangement according to claim 1. wherein a plurality of barrier panels is arranged in an end-to-end configuration and define a substantially continuous lower tap rail.

* * * * *